US008187026B2

(12) United States Patent
Tachiki

(10) Patent No.: US 8,187,026 B2
(45) Date of Patent: May 29, 2012

(54) STRUCTURE OF A COMPONENT MOUNTING PORTION, AND FUNCTIONAL UNIT

(75) Inventor: Hiroshi Tachiki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/187,339

(22) Filed: Jul. 20, 2011

(65) Prior Publication Data

US 2012/0034802 A1 Feb. 9, 2012

(30) Foreign Application Priority Data

Aug. 9, 2010 (JP) ..... 2010-178395

(51) Int. Cl.
*H01R 13/66* (2006.01)
*B25G 3/00* (2006.01)

(52) U.S. Cl. ..... 439/527; 439/352; 403/409.1

(58) Field of Classification Search ..... 439/345, 439/350–358, 367–373, 527, 532, 540.1, 439/568–569, 571–575; 403/409.1
See application file for complete search history.

(56) References Cited

U.S. PATENT DOCUMENTS 7,841,886 B2 * 11/2010 Klein ..... 439/352
8,062,051 B2 * 11/2011 Ngo ..... 439/352
2012/0015546 A1 * 1/2012 Yamaguchi et al. ..... 439/370

FOREIGN PATENT DOCUMENTS

JP 62-112803 U 7/1987
JP 7-280425 A 10/1995
JP 2008-37287 A 2/2008

* cited by examiner

*Primary Examiner* — Khiem Nguyen
(74) *Attorney, Agent, or Firm* — Birch, Stewart, Kolasch & Birch, LLP

(57) ABSTRACT

A mounting portion is configured to mount thereon a first coupler provided with a pair of engagement arms having an elastic force in a width increasing direction. The mounting portion includes a pair of support members. The pair of support members each have a support portion, an inclined portion, a first engagement portion, and a second engagement portion. A spacing between the second engagement portions is larger than a widthwise dimension of the first coupler which is taken on when the engagement arms are displaced into a position at which the widthwise dimension of the first coupler is minimized. A space allowing the first and second couplers in a state of being coupled to each other to be placed therein is provided on a downstream side of the mounting portion in a removing direction.

4 Claims, 10 Drawing Sheets

STRUCTURE OF A COMPONENT MOUNTING PORTION, AND FUNCTIONAL UNIT

CROSS REFERENCE

This Nonprovisional application claims priority under 35 U.S.C. §119(a) on Patent Application No. 2010-178395 filed in Japan on Aug. 9, 2010, the entire contents of which are hereby incorporated by reference.

BACKGROUND OF THE INVENTION

The present invention relates to a structure of a component mounting portion configured to mount thereon a component provided with a pair of engagement arms having an elastic force such as to enable the engagement arms to move toward and away from each other in a widthwise direction, as well as a functional unit incorporating such a structure.

An electronic apparatus, such as an image forming apparatus, includes a functional unit such as a secondary transfer belt unit. Such a functional unit has electrical components including an electromagnetic clutch and a sensor. A junction cable included in an electric circuit associated with such electrical components is sometimes provided at an intermediate portion thereof with a coupler pair as a terminal interconnecting a plurality of electrical wiring lines, such as a power line and a signal line, collectively.

The coupler pair includes first and second couplers which can be coupled to each other. Among components including such a first coupler, there are components of the type which includes a pair of engagement arms having an elastic force such as to enable the engagement arms to move toward and away from each other in a widthwise direction. With a conventional structure of a component mounting portion, the first coupler is mounted by bringing the pair of engagement arms into engagement with an engagement hole formed in a panel-shaped mounting portion provided in a housing and then the second coupler is coupled to first coupler mounted on the mounting portion, as described in Japanese Patent Laid-Open Publication No. HEI7-280425. Such an arrangement offers an improved operability in interconnecting a plurality of electric wiring lines.

However, when the first coupler is removed from the mounting portion for the reason of electric component replacement or other reason, the first coupler is withdrawn from the engagement hole by deforming the engagement arms against their elastic force. Such a removing operation is poor in operability and might break the engagement arms.

A feature of the present invention is to provide a structure of a component mounting portion which has a high operability in removing the component from the mounting portion and which is capable of suppressing breakage of the engagement arms.

SUMMARY OF THE INVENTION

In a structure of a component mounting portion according to the present invention, the component mounting portion is configured to mount thereon a component provided with a pair of engagement arms having an elastic force such as to enable the engagement arms to move toward and away from each other in a widthwise direction as a first direction of first, second and third directions which are perpendicular to each other. The component mounting portion comprises a pair of support members or holding the component therebetween by pressure contact therewith when the component is in a mounted state on the component mounting portion. The pair of support members each have: a support portion extending in the second direction which is a mounting direction in which the component is to be mounted on the component mounting portion, the support portion being pressure-contacted by an associated one of the engagement arms when the component is in the mounted state; an inclined portion which is inclined in a direction toward a counterpart inclined portion as the inclined portion extends downstream in the mounting direction and which is continuous with an upstream end of the support portion; and first and second engagement portions located at opposite ends of the support portion in the third direction. A spacing between the first engagement portions and a spacing between the second engagement portions are smaller than a spacing between the support portions. At least one of the spacing between the first engagement portions and the spacing between the second engagement portions is larger than a widthwise dimension of the component across the engagement arms which is taken on when the engagement arms are displaced into a position at which the widthwise dimension of the component is minimized within a range of motion of the engagement arms by elastic deformation. A space allowing the component to be placed therein is provided on a downstream side of the component mounting portion in a removing direction in which the component is to be removed from the component mounting portion and which is at least one of opposite directions along the third direction.

With this arrangement, in mounting the component on the component mounting portion the engagement arms of the component are pushed into between the support portions while sliding along the inclined portions. Since the engagement arms has an elastic force in the widthwise direction, the component is held between the pair of support portions by pressure contact therewith. The spacing between the first engagement portions located at one end of the support portions in the third direction and the spacing between the second engagement portions located at the other end of the support portions in the third direction are smaller than the spacing between the support portions. This feature enables the engagement arms to be held between the support portions unless a force equal to and more than a predetermined value is exerted on the engagement arms.

In removing the component from the component mounting portion, on the other hand, the component is pushed by fingers of an operator or the like with the force equal to and more than the predetermined value in the removing direction which is perpendicular to both of the widthwise direction and the mounting direction. The removing direction is a direction in which the component is moved toward one of the spacing between the first engagement portions and the spacing between the second engagement portions, whichever is larger than the widthwise dimension of the component across the engagement arms which is taken on when the engagement arms are displaced into the position at which the widthwise dimension of the first coupler is minimized within the range of motion of the engagement arms by elastic deformation. As the component is pushed in the removing direction, the engagement arms pass between the first engagement portions or between the second engagement portions while deforming by a necessary and minimum amount along the first engagement portions or the second engagement portions against their elastic force, thus making the component come out from between the support portions, from between the first engagement portions and from between the second engagement portions. In this way, the component can be removed from the component mounting portion by being simply pushed in one direction. At that time, the engagement arms are not directly operated by the operator and, hence, no excessive force is exerted on the engagement arms.

DETAILED DESCRIPTION OF THE PREFERRED EMBODIMENTS

Hereinafter, an embodiment of the present invention will be described with reference to the attached drawings.

Figure 1:
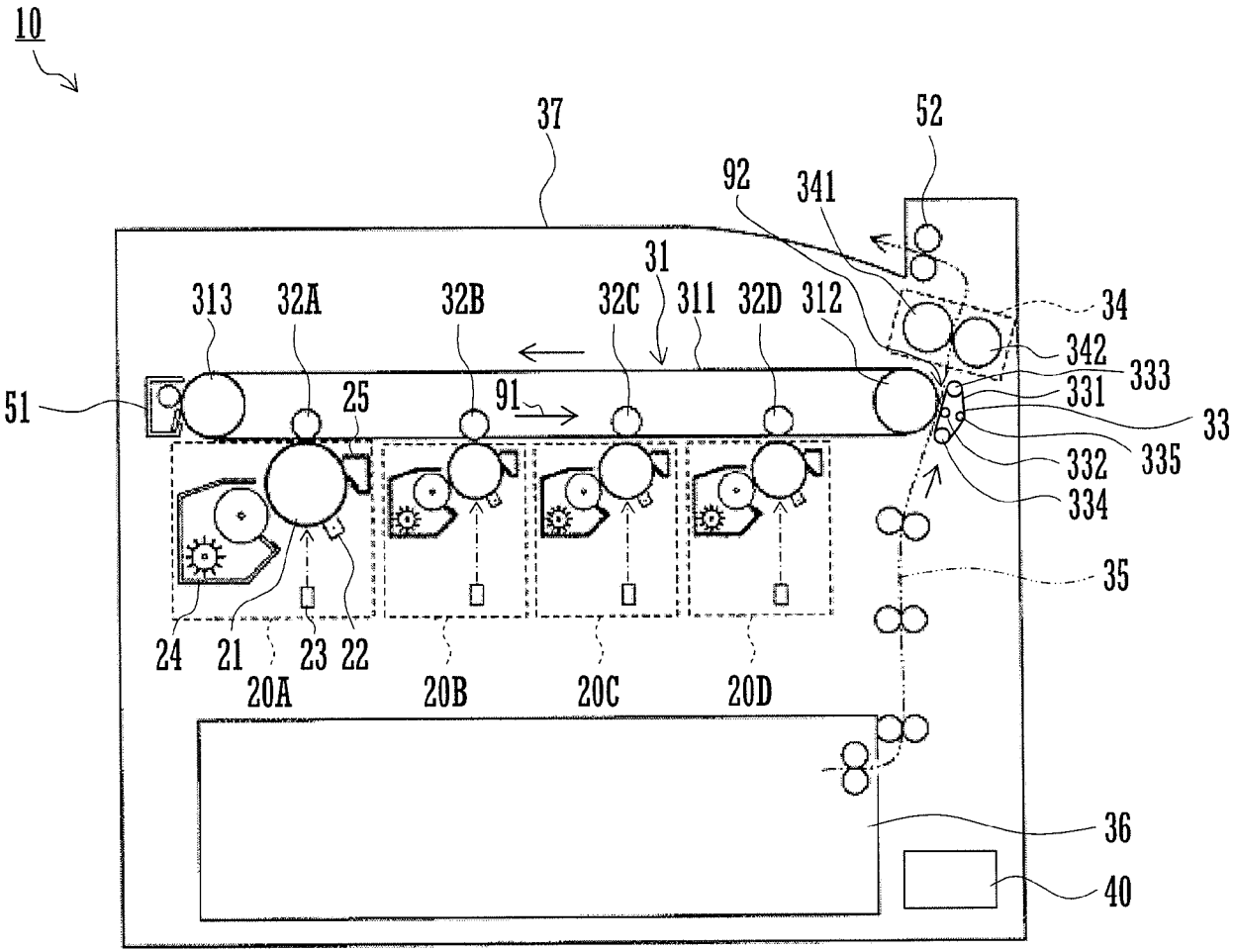
FIG. 1 is a view schematically illustrating an image forming apparatus incorporating a functional unit having a structure of a component mounting portion according to an embodiment of the present invention.

Referring to FIG. 1, an image forming apparatus 10 shown is configured to form a polychrome or monochrome image on a recording sheet according to image data. Examples of such recording sheets include plain paper sheets, photographic paper sheets and OHP films. The image forming apparatus 10 includes image forming stations 20A to 20D, an intermediate transfer belt unit 31, a plurality of primary transfer rollers 32A to 32D, a secondary transfer belt unit 33, a fixing device 34, a sheet feed path 35, a sheet feed tray 36, a sheet catch tray 37, and a power control unit 40.

The image forming apparatus 10 carries out an electrophotographic image forming process using image data items corresponding to four colors: black and the three subtractive primary colors, i.e., cyan, magenta and yellow, obtained by color separation of a color image. The image forming stations 20A to 20D are configured to form toner images of the respective colors. The image forming stations 20A to 20D are horizontally arranged in a row along the intermediate transfer belt unit 31.

The following description is directed mainly to the image forming station 20A. The other image forming stations 20B to 20D are substantially similar in configuration to the image forming station 20A. The image forming station 20A, which is associated with black, includes a photoreceptor drum 21, an electrostatic charger device 22, an exposure device 23, a developing device 24, and a cleaning unit 25 and is configured to form a black toner image by the electrophotographic image forming process.

The photoreceptor drum 21, which is an electrostatic latent image bearing member, is rotated in one direction by a driving force transmitted thereto from a non-illustrated first driving source.

The electrostatic charger device 22 is disposed to face the peripheral surface of the photoreceptor drum 21 and configured to electrostatically charge the peripheral surface of the photoreceptor drum 21 to a predetermined potential uniformly.

The exposure device 23 is configured to irradiate the peripheral surface of the photoreceptor drum 21 with a laser beam modulated according to a black image data item. By such irradiation, an electrostatic latent image according to the black image data item is formed on the peripheral surface of the photoreceptor drum 21.

The developing device 24 contains therein a black developer. An example of such a developer for use in the image forming apparatus 10 is a two-component system developer comprising a toner and a carrier. The developing device 24 agitates the toner and the carrier to charge the toner electrostatically. The developing device 24 feeds the toner to the peripheral surface of the photoreceptor drum 21 on which the electrostatic latent image is formed, to develop the electrostatic latent image into a toner image.

The developing devices 24 of respective of the other image forming stations 20B to 20D contain therein a cyan developer, a magenta developer, and a yellow developer, respectively. The photoreceptor drums 21 of the respective image forming stations 20B to 20D are configured to form a cyan toner image, a magenta toner image, and a yellow toner image, respectively.

The intermediate transfer belt unit 31 includes an intermediate transfer belt 311, a driving roller 312, and a driven roller 313. The intermediate transfer belt 311 is formed using a film having a predetermined thickness within a range from 100 μm to 150 μm for example. The intermediate transfer belt 311 is in the form of an endless belt and is entrained about the driving roller 312 and the driven roller 313 for revolution therearound in one direction. The outer peripheral surface of the intermediate transfer belt 311 is opposed to the photoreceptor drums 21 of the respective image forming stations 20A to 20D.

The primary transfer rollers 32A to 32D are opposed to the photoreceptor drums 21 of the respective image forming stations 20A to 20D across the intermediate transfer belt 311. The primary transfer rollers 32B to 32D are substantially similar in structure to the primary transfer roller 32A. The regions in which the intermediate transfer belt 311 is opposed to the photoreceptor drums 21 of the respective image forming stations 20A to 20D are primary transfer regions.

The primary transfer rollers 32A to 32D are each applied with a primary transfer bias having a polarity (e.g., positive polarity) opposite to the polarity (e.g., negative polarity) of electrostatically charged toner by constant voltage control in order to perform primary transfer of toner images born on the peripheral surfaces of the respective photoreceptor drums 21 onto the intermediate transfer belt 311. Thus, the toner images of the respective colors formed on the peripheral surfaces of the photoreceptor drums 21 of the respective image forming stations 20A to 20D are sequentially transferred (primarily transferred) onto the outer peripheral surface of the intermediate transfer belt 311 so as to be superimposed on one another, so that a full-color toner image is formed on the outer peripheral surface of the intermediate transfer belt 311.

In cases where only those image data items which correspond to some of the colors, i.e., yellow, magenta, cyan and black, are inputted, only those photoreceptor drums of the four photoreceptor drums 21 which are associated with the colors corresponding to the image data items inputted perform electrostatic latent image formation and toner image formation. In monochrome image formation for example, only that photoreceptor drum 21 which is associated with black performs electrostatic latent image formation and toner image formation, so that only a black toner image is transferred onto the outer peripheral surface of the intermediate transfer belt 311.

The cleaning unit 25 is configured to remove and recover residual toner remaining on the peripheral surface of the photoreceptor drum 21 after the primary transfer following the developing step.

The toner images that have been transferred onto the outer peripheral surface of the intermediate transfer belt 311 in the respective primary transfer regions are moved into a secondary transfer region 92 by revolution of the intermediate transfer belt 311.

The secondary transfer belt unit 33 includes a secondary transfer belt 331, a secondary transfer roller 332, a secondary transfer driving roller 333, a secondary transfer driven roller 334, and a secondary transfer tension roller 335.

The secondary transfer belt 331 is in the form of an endless belt. A belt for use as the secondary transfer belt 331 has a predetermined electric resistance (within the range from $1\times10^{10}$ to $5\times10^{10}$ Ωcm for example).

The secondary transfer belt 331 is entrained about the secondary transfer roller 332, secondary transfer driving roller 333, secondary transfer driven roller 334 and secondary transfer tension roller 315. The outer peripheral surface of the secondary transfer belt 331 is pressed against the outer peripheral surface of the intermediate transfer belt 331 at a predetermined nip pressure.

The region in which the intermediate transfer belt 331 and the secondary transfer belt 331 are pressed against each other is the secondary transfer region 92. A recording sheet is fed along the outer peripheral surface of the secondary transfer belt 331. The recording sheet thus fed into the secondary transfer region 92 is brought into intimate contact with the intermediate transfer belt 311.

The sheet feed tray 36 accommodates recording sheets therein. The sheet feed path 35 is designed to guide each of the recording sheets accommodated in the sheet feed tray 36 to the sheet catch tray 37 via the secondary transfer region 92 and the fixing device 34.

Each recording sheet fed from the sheet feed tray 36 is conveyed so as to pass through the secondary transfer region 92 with predetermined timing. The secondary transfer roller 332 is opposed to the driving roller 312 across the secondary transfer belt 331 and the intermediate transfer belt 311. The power control unit 40 applies the secondary transfer roller 332 with a secondary transfer bias having a polarity (e.g., positive polarity) opposite to the polarity (e.g., negative polarity) of the toner electrostatically charged. Thus, the toner image born on the intermediate transfer belt 311 is secondarily transferred onto the recording sheet.

An intermediate transfer belt cleaning unit 51 recovers residual toner of the toner born on the intermediate transfer belt 311 that remains on the intermediate transfer belt 311 without having been transferred to the recording sheet, in order to prevent color mixture from occurring in the subsequent steps.

The fixing unit 34 includes a heating roller 341 and a pressurizing roller 342. The recording sheet bearing the toner image transferred thereto is guided into the fixing unit 34 where the recording sheet is heated and pressurized during its passage between the heating roller 341 and the pressurizing roller 342. In this way, the toner image is firmly fixed to the recording sheet. The recording sheet bearing the toner image thus fixed thereto is outputted to the sheet catch tray 37 by a sheet output roller pair 52.

Figure 2:
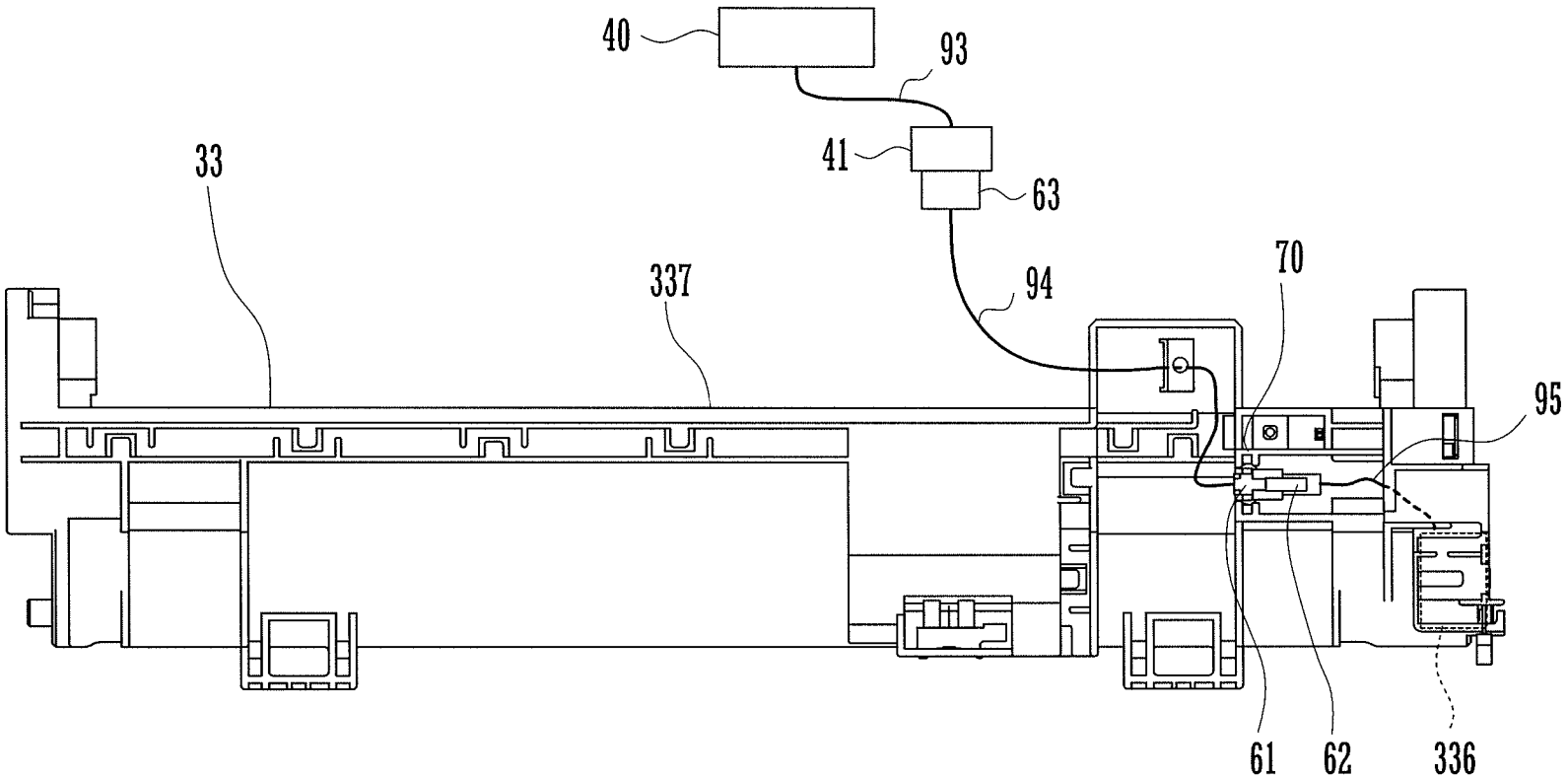
FIG. 2 is a plan view of the functional unit.

As shown in FIG. 2, the secondary transfer belt unit 33 further includes an electromagnetic clutch 336. The electromagnetic clutch 336 controls the operation of the secondary transfer driving roller 333. The electromagnetic clutch 336, which is an electrical component, receives electric power and control signals inputted thereto from the power control unit 40.

The electromagnetic clutch 336 and the power control unit 40 are interconnected through electrical wiring lines 93, 94 and 95 provided with first and second couplers 61 and 62 at an intermediate point. The first coupler 61 and the second coupler 62 form a coupler pair and can be coupled to each other. In an exemplary case, the first coupler 61 is a male coupler and the second coupler 62 is a female coupler. The first and second couplers 61 and 62 are terminals for connecting a plurality signal lines to their associated signal lines collectively. Though each of the electrical wiring lines 93, 94 and 95 is shown as a single line in FIG. 2, each electrical wiring line comprises a plurality of signal lines actually.

The power control unit 40 is connected to a first connection terminal 41 through the electrical wiring line 93. The first coupler 61 is connected to a second connection terminal 63 through the electrical wiring line 94, the second connection terminal 63 being connectable to the first connection terminal 41. The second coupler 62 is connected to the electromagnetic clutch 336 through the electrical wiring line 95.

In replacement of the electromagnetic clutch 336 for example, the second coupler 62 is detached from the first coupler 61 and then the second coupler 62 of replacing electromagnetic clutch 336 is coupled to the first coupler 61.

Figure 3:
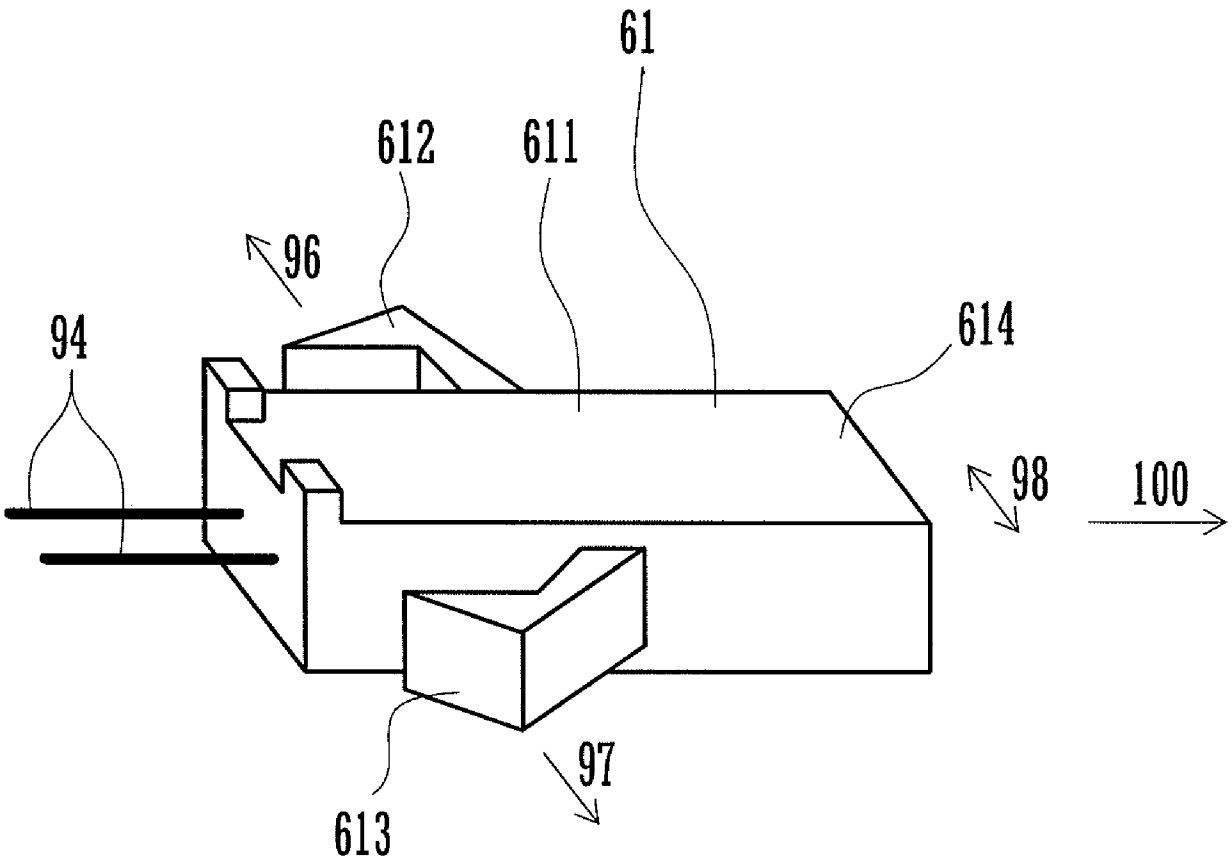
FIG. 3 is a perspective view illustrating a first coupler.

As shown in FIG. 3, the first coupler 61 includes a first coupler body 611 and a pair of engagement arms 612 and 613.

The engagement arms 612 and 613 are each V-shaped. The engagement arms 612 and 613 are positioned to project in width increasing directions 96 and 97 in which the widthwise dimension of the first coupler 61 increases, in such a manner that the widthwise dimension of the first coupler 61 gradually increases and then gradually decreases as the first coupler 61 extends in a removing direction 100 to be described later in which the first coupler 61 is to be removed. The engagement arms 612 and 613 have respective outer surfaces in a widthwise direction 98, each of which comprises a projecting portion which is most projecting in the width increasing direction 96 or 97, and inclined surfaces extending continuously from the projecting portion on opposite sides of the projecting portion in the removing direction 100. The inclined surfaces are each inclined in a direction from the projecting portion toward the first coupler body 611.

The engagement arms 612 and 613 have respective distal ends which are located farther from the electrical wiring lines 94 than the ends opposite away therefrom and are fixed to the opposite sides of the first coupler body 611. Specifically, the distal end of the engagement arm 612 is fixed to one side of the first coupler body 611, while the distal end of the engagement arm 613 is fixed to the other side of the first coupler body 611. The pair of engagement arms 612 and 613 have an elastic force such as to enable the engagement arms 612 and 613 to move toward and away from each other in the widthwise direction 98.

Figure 4:
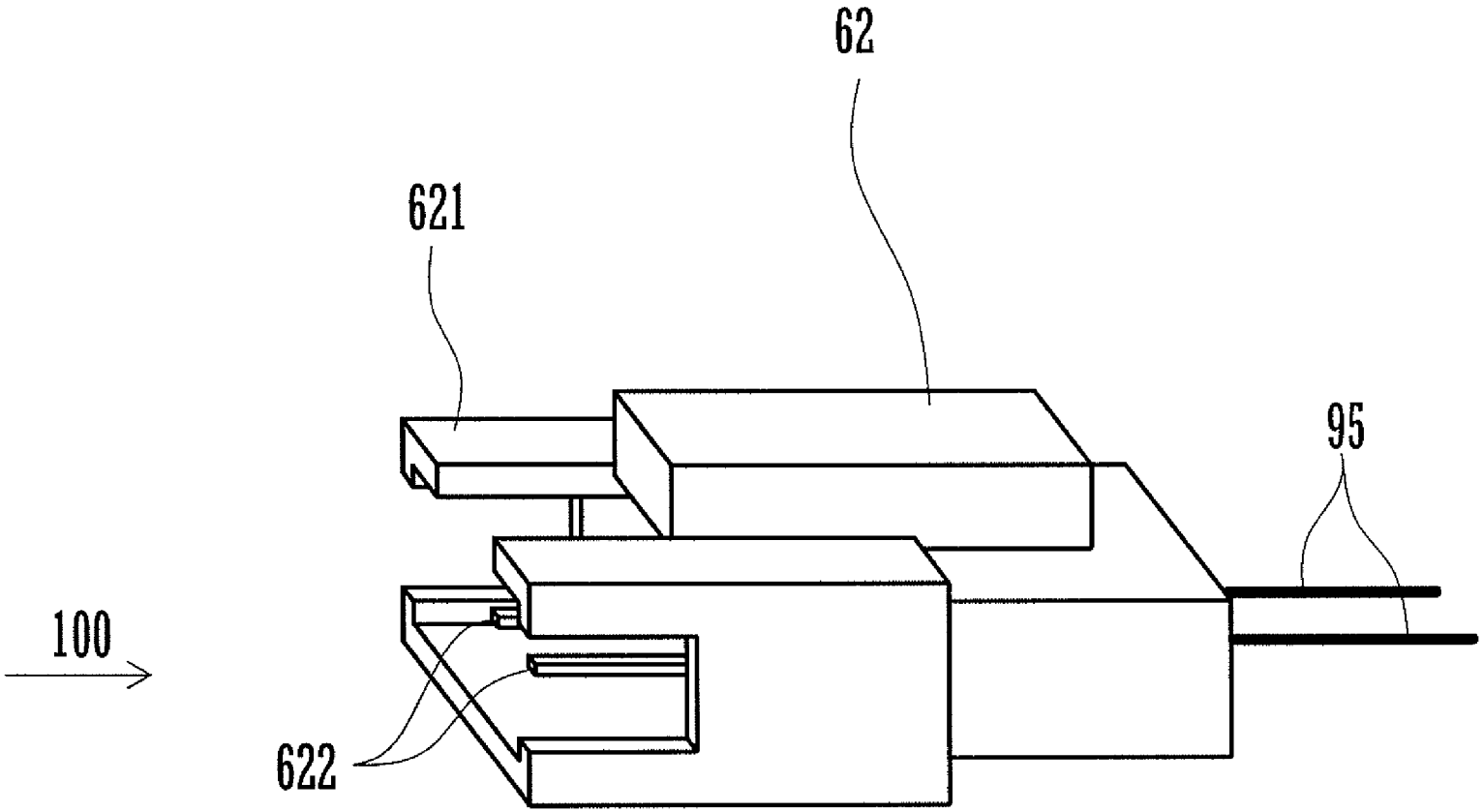
FIG. 4 is a perspective view illustrating a second coupler.

The first coupler 61 has a first coupling portion 614 at an opposite end of the first coupler body 611 away from the end from which the electrical wiring lines 94 extend, the first coupling portion 614 having a socket portion for receiving pins 622 of the second coupler 62 therein (see FIG. 4).

As shown in FIG. 4, the second coupler 62 has a second coupling portion 621 at an opposite end thereof away from the end from which the electrical wiring lines 95 extend. The second coupling portion 621 is dented for receiving the first coupling portion 614 of the first coupler 61 therein. The coupling portion 612 is provided with the pins 622 to be inserted into the socket portion of the first coupler 61.

Figure 5:
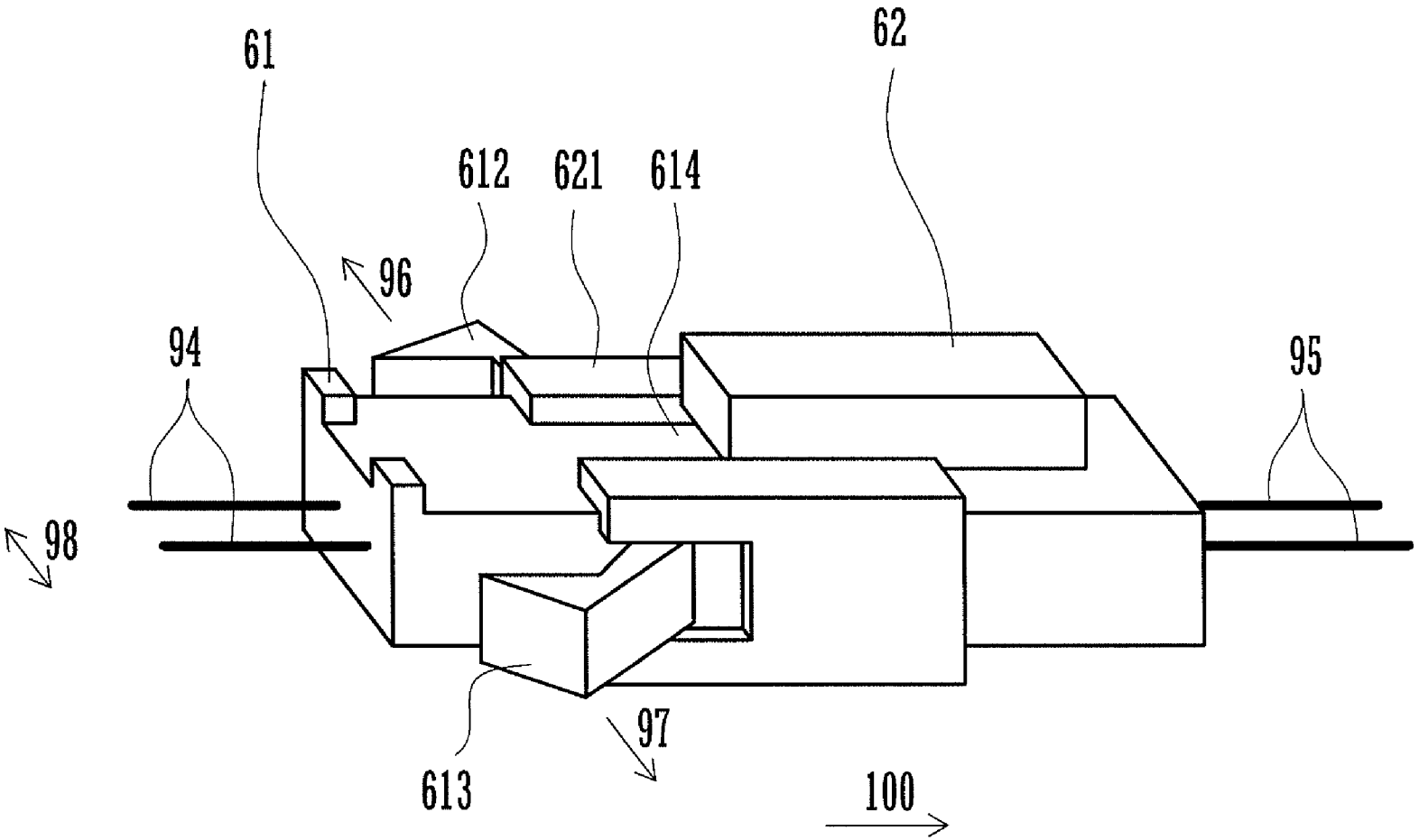
FIG. 5 is a perspective view of the first and second couplers in a state of being coupled to each other.

As shown in FIG. 5, in a coupled state of the first and second couplers 61 and 62, the first coupling portion 614 of the first coupler 61 is fitted in the second coupling portion 621 of the second coupler 62, with the pins 622 of the second coupler 62 being inserted in the socket portion of the first coupler 61. Even when the first and second couplers 61 and 62 are in the coupled state, the pair of engagement arms 612 and 613 project in the width increasing directions 96 and 97 of the first and second couplers 61 and 62.

As shown in FIG. 2, a housing 337 of the secondary transfer belt unit 33 is provided with a mounting portion 70. The first coupler 61 in the state of being coupled to the second coupler 62 is mounted on the mounting portion 70. The first coupler 61 is an exemplary component to be mounted on the mounting portion 70.

Figure 6:
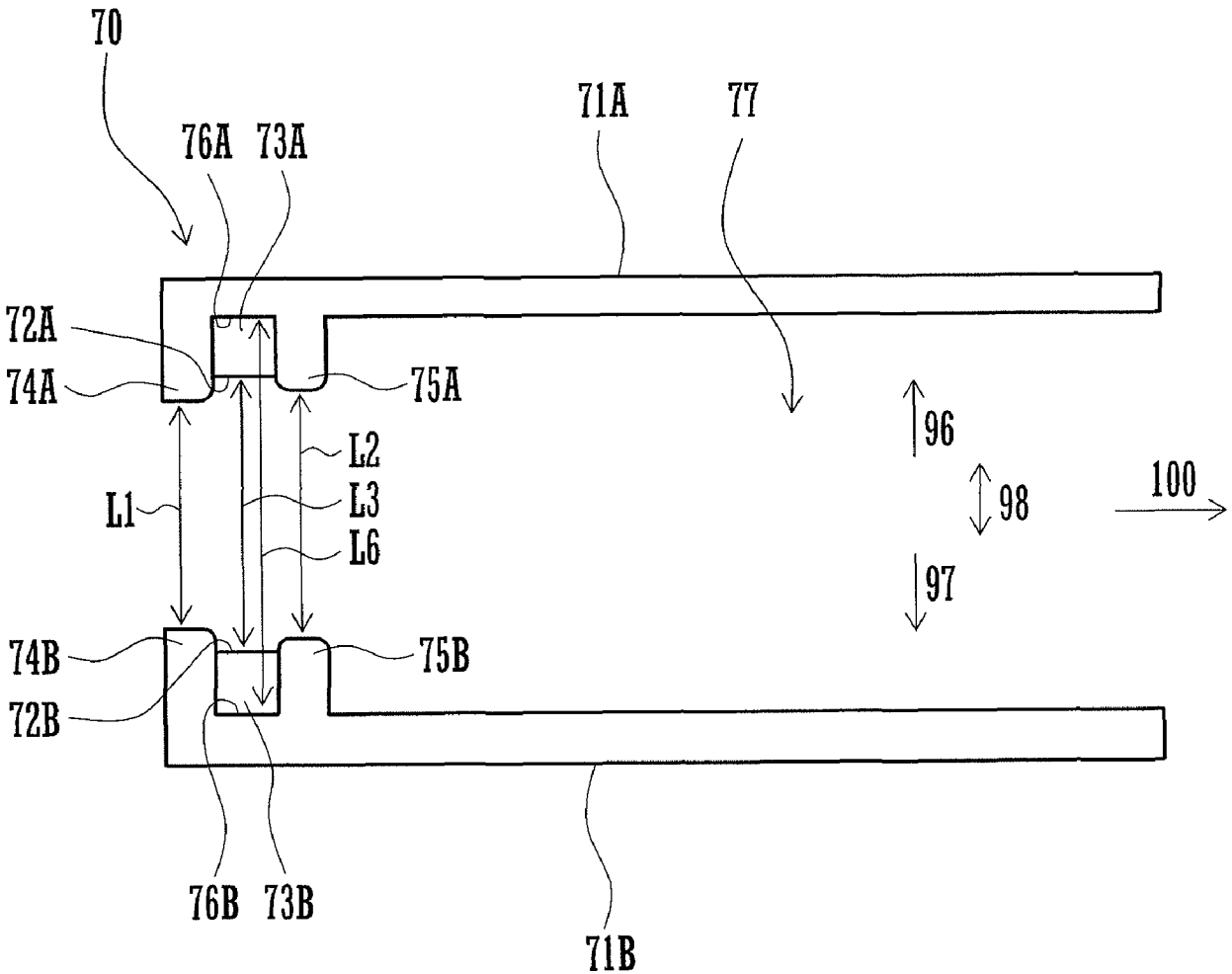
FIG. 6 is a plan view of the mounting portion.
Figure 7:
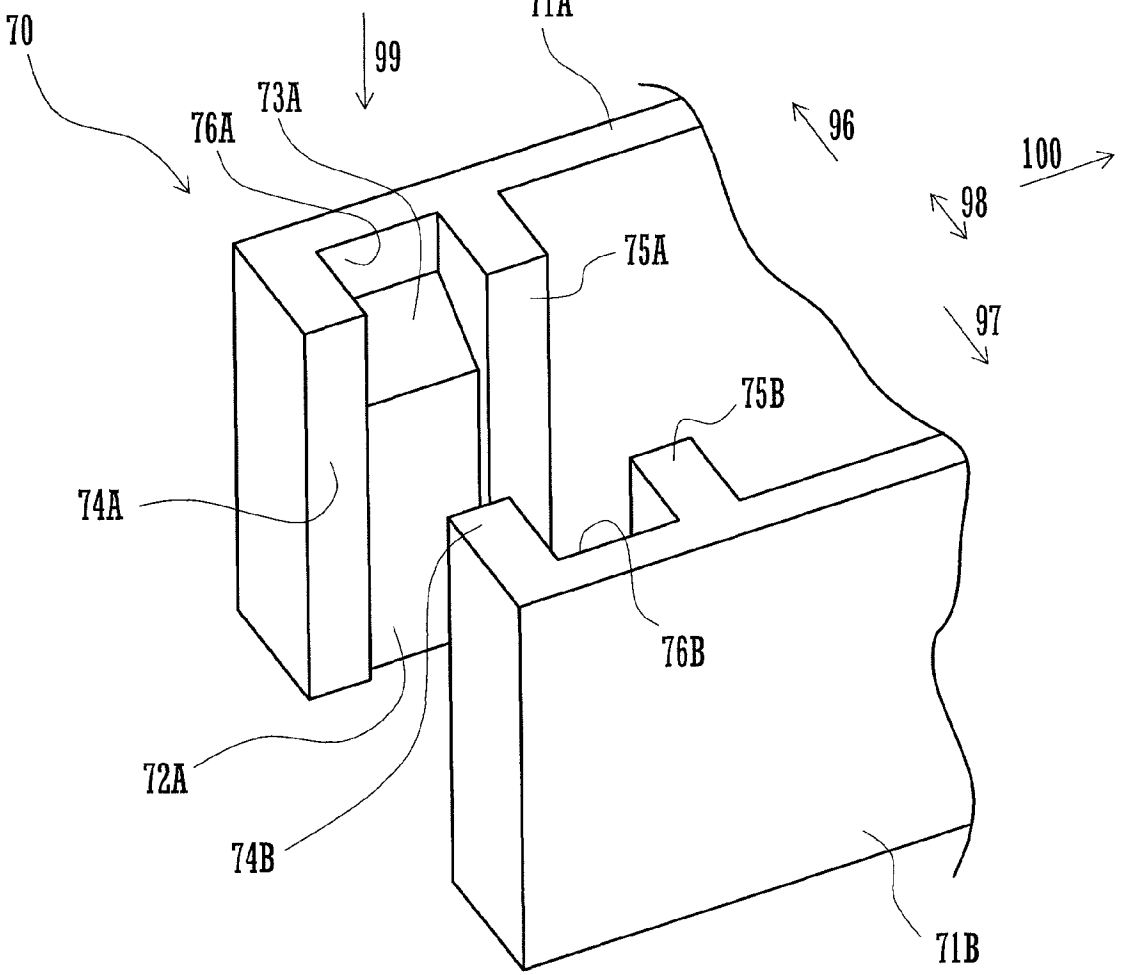
FIG. 7 is a fragmentary perspective of the mounting portion.

As shown in FIGS. 6 and 7, the mounting portion 70 comprises a pair of support members 71A and 71B. When the first coupler 61 is in a mounted state, the support members 71A and 71B are positioned to hold the first coupler 61 therebetween by pressure contact therewith.

The support member 71A has a support portion 72A, an inclined portion 73A, a first engagement portion 74A, and a second engagement portion 75A. The support member 71B has a support portion 72B, an inclined portion 73B, a first engagement portion 74B, and a second engagement portion 75B.

The support portions 72A and 72B extend in a mounting direction 99 in which the first coupler 61 is to be mounted on the mounting portion 70. When the first coupler 61 is in the mounted state of being mounted on the mounting portion 70, the widthwise direction 98, the mounting direction 99 and the removing direction 100 in which the first coupler 61 is to be removed from the mounting portion 70 are perpendicular to each other. The support portions 72A and 72B extends parallel with each other. When the first coupler 61 is in the mounted state on the mounting portion 70, the engagement arms 612 and 613 are in pressure contact with the support portions 72A and 72B.

The inclined portions 73A and 73B are inclined in directions toward each other as they extend downstream in the mounting direction 99. The inclined portions 72A and 72B are continuous with the upstream ends of the respective support portions 72A and 72B.

On the upstream side of the inclined portions 73A and 73B in the mounting direction 99, introductive portions 76A and 76B are provided which extend continuously with the upstream ends of the inclined portions 73A and 73B. The introductive portions 76A and 76B extend parallel with each other.

The first engagement portion 74A and the second engagement portion 75A are located at opposite ends of the support portion 72A in the removing direction 100. Likewise, the first engagement portion 74B and the second engagement portion 75B are located at opposite ends of the support portion 72B in the removing direction 100. The first engagement portion 74A and the first engagement portion 74B are opposed to each other and, likewise, the second engagement portion 75A and the second engagement portion 75B are opposed to each other.

The spacing L1 between the first engagement portion 74A and the first engagement portion 74B and the spacing L2 between the second engagement portion 75A and the second engagement portion 75B are smaller than the spacing L3 between the support portions 72A and 72B.

The first coupler 61 has a widthwise dimension L4 across the projecting portions of the engagement arms 612 and 613 which is taken on when the engagement arms 612 and 613 are displaced into a position at which the widthwise dimension of the first coupler 61 is minimized within a range of motion of the engagement arms 612 and 613 by elastic deformation, the projecting portions being most projecting in the width increasing directions 96 and 97.

At least one of the spacing L1 and the spacing L2 is larger than the widthwise dimension L4. In this embodiment, the spacing L2 is larger than the widthwise dimension L4, while the spacing L1 is smaller than the widthwise dimension L4.

The first coupler 61 has a widthwise dimension L5 across the projecting portions of the engagement arms 612 and 613 which is taken on when the engagement arms 612 and 613 are in their usual position without elastic deformation. The introductive portions 76A and 76B define a spacing L6 therebetween. The dimensions described above are established as follows.

Since the spacing L3 is smaller than the widthwise dimension L5, the engagement arms 612 and 613 are in pressure contact with the support portions 72A and 72B when the first coupler 61 is in the mounted state on the mounting portion 70. Since the spacing L6 is larger than the widthwise dimension L5, the first coupler 61 can be readily inserted between the introductive portions 76A and 76B in the operation of mounting the first coupler 61 on the mounting portion 70.

That is, the dimensions established in the present embodiment are as follows:

$L1<L4<L2<L3<L5<L6$.

Those angular portions of the first engagement portions 74A and 74B and second engagement portions 75A and 75B which are located on the downstream side in the removing direction 100 are chamfered.

Figure 8:
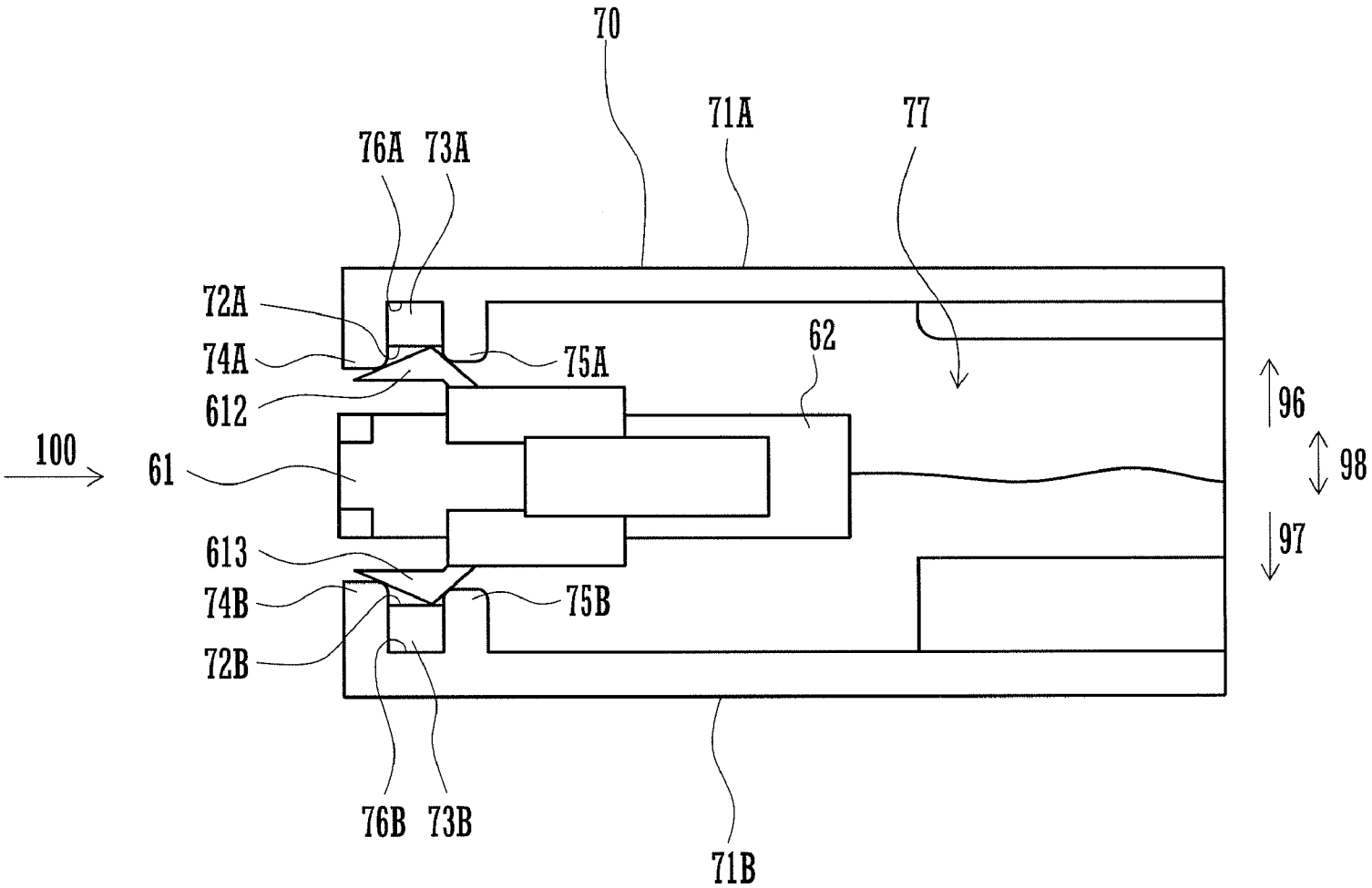
FIG. 8 is a plan view illustrating the mounting portion and the first and second couplers in a state in which engagement arms are supported by support portions.

As shown in FIG. 8, the first coupler 61 is first coupled to the second coupler 62 and is then mounted on the mounting portion 70 with the second coupler 62 coupled to the first coupler 61.

In mounting the first coupler 61 on the mounting portion 70, the pair of engagement arms 612 and 613 are forced into the space between the support portions 72A and 72B while sliding along the inclined portions 73A and 73B. Since the engagement arms 612 and 613 has an elastic force in the widthwise direction 98, the first coupler 61 is held between the support members 71A and 71B by pressure contact therewith.

The projecting portions of the engagement arms 612 and 613 which are most projecting in the width increasing directions 96 and 97 are pressed against the support portions 72A and 72B, while the inclined surfaces extending continuously from the projecting portions of the engagement arms 612 and 613 are brought into pressure contact with the first engagement portions 74A and 74B and the second engagement portions 75A and 75B. Thus, the first coupler 61 can be stably mounted on the mounting portion 70.

Since the spacing L1 between the first engagement portions 74A and 74B and the spacing L2 between the second engagement portions 75A and 75B are smaller than the spacing L3 between the support portions 72A and 72B, the engagement arms 612 and 613 are kept as held between the support portions 72A and 72B unless a force equal to and more than the predetermined value is exerted thereon in the removing direction 100.

With the first coupler 61 in the mounted state on the mounting portion 70, the first and second couplers 61 and 62 and the electrical wiring lines 94 and 95 are positioned to extend along the housing 337, so that they are inhibited from projecting from the housing 337. Therefore, the secondary transfer belt unit 33 requires a reduced space to be occupied thereby.

Figure 9:
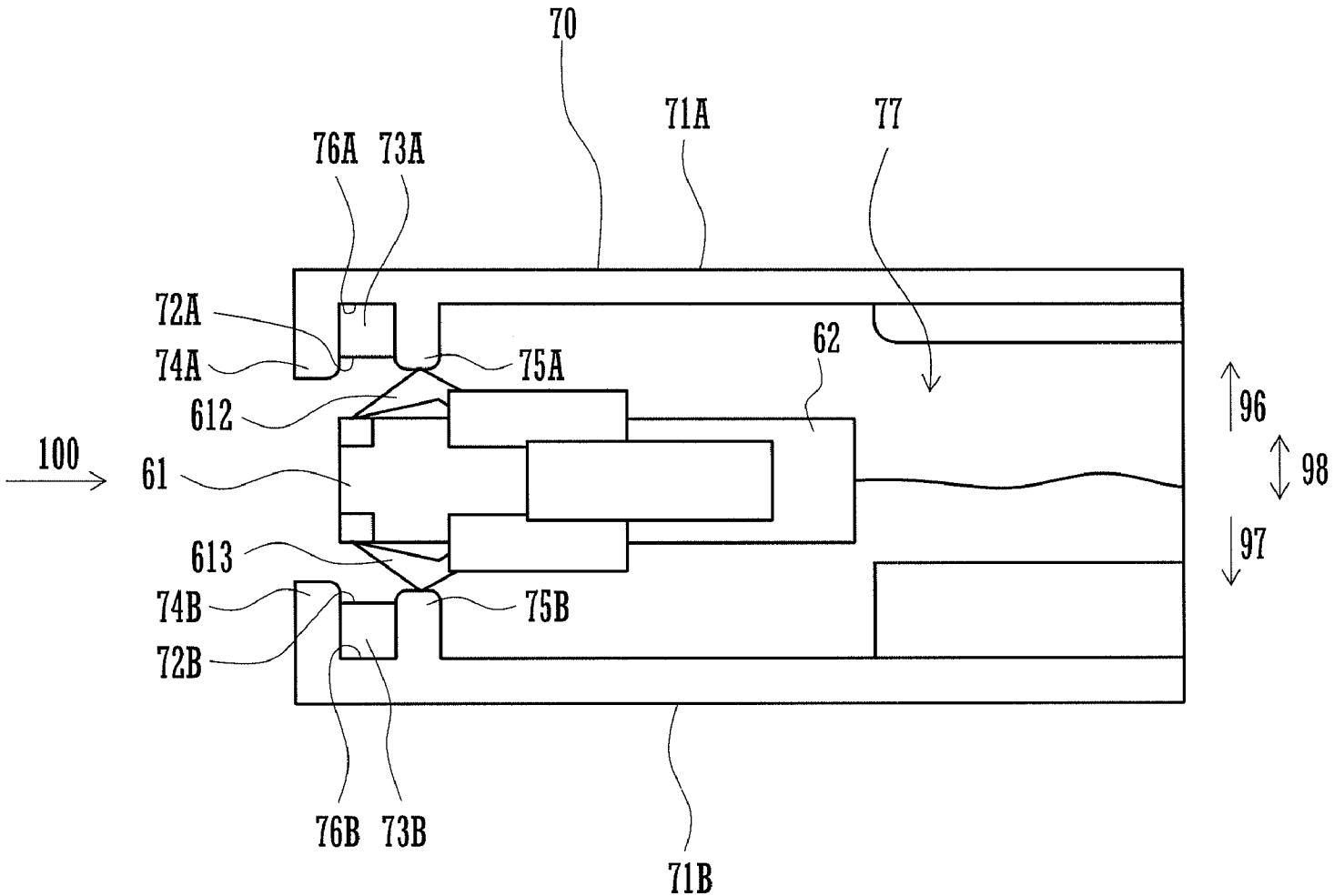
FIG. 9 is a plan view illustrating the mounting portion and the first and second couplers in a state in which the engagement arms pass between second engagement portions while deforming elastically.

As shown in FIG. 9, in removing the first coupler 61 from the mounting portion 70 the first coupler 61 is pushed by fingers of the operator or the like with a force equal to and more than the predetermined value in the removing direction 100.

On the downstream side of the mounting portion 70 in the removing direction 100 there is provided a space 77 which allows the first and second couplers 61 and 62 in the state of being coupled to each other to be placed therein.

Figure 10:
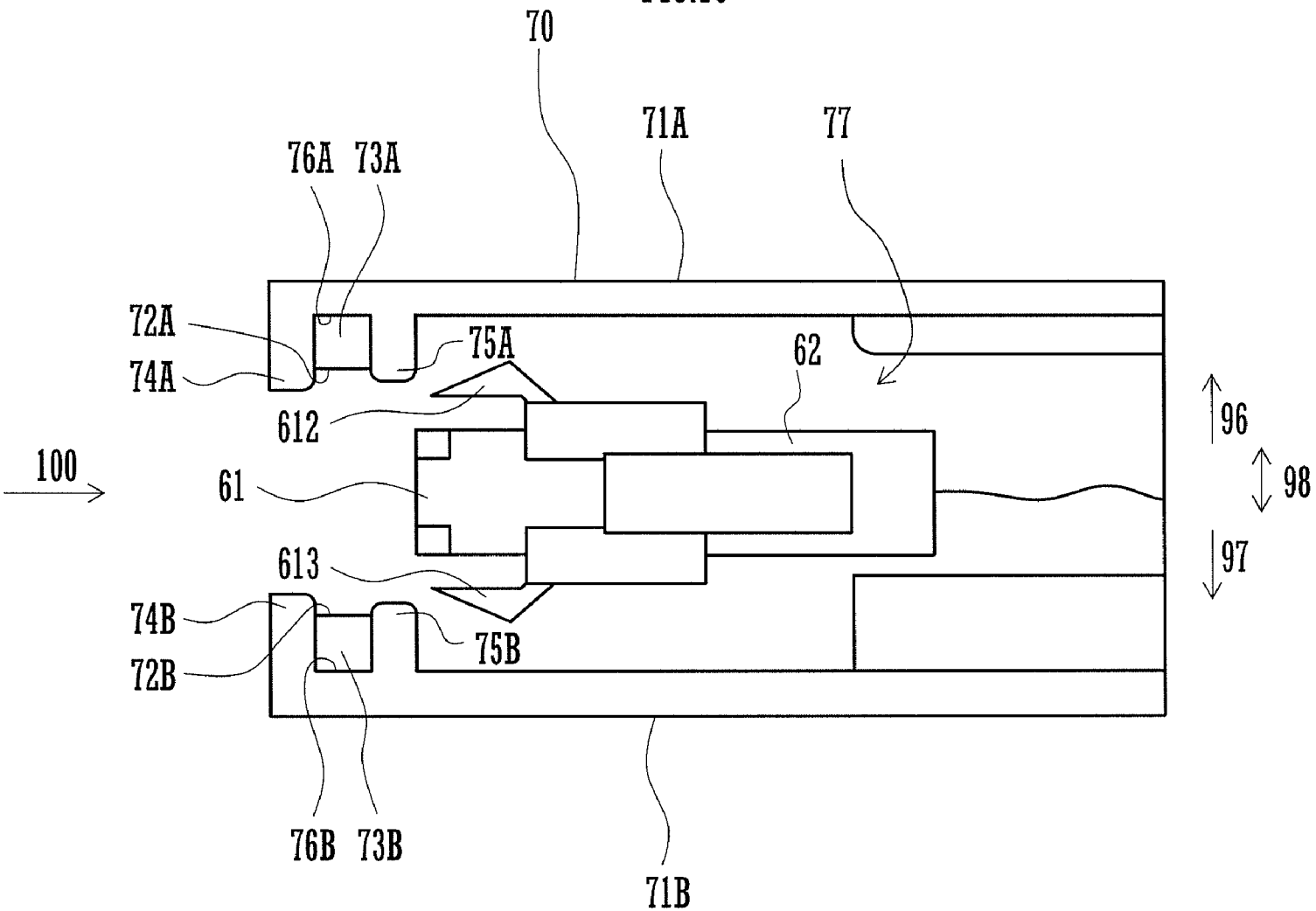
FIG. 10 is a plan illustrating the mounting portion and the first and second couplers in a state in which the engagement arms have been removed from the support portions.

As the first coupler 61 is pushed in the removing direction 100, the engagement arms 612 and 613 pass between the second engagement portions 75A and 75B while deforming by a necessary and minimum amount along the second engagement portions 75A and 75B against their elastic force. Thus, the first coupler 61 comes out from between the support portions 72A and 72B, from between the first engagement portions 74A and 74B and from between the second engagement portions 75A and 75B, as shown in FIG. 10.

In removing the first coupler 61 from the mounting portion 70, the first coupler 61 can be thus removed from the mounting portion 70 by being simply pushed in one direction. At that time, the operator does not directly operate the engagement arms 612 and 613 and, hence, any excessive force is not exerted on the engagement arms 612 and 613. Therefore, the first coupler 61 can be removed from the mounting portion 70 with a high operability, and breakage of the engagement arms 612 and 613 can be suppressed.

Further, since the spacing L1 between the first engagement portions 74A and 74B is smaller than the widthwise dimension L4, the first coupler 61 can be prevented from coming off the mounting portion 70 in a direction not intended by the operator.

It is possible that the spacing L1 between the first engagement portions 74A and 74B is made larger than the widthwise dimension L4 while the spacing L2 between the second engagement portions 75A and 75B made smaller than the widthwise dimension L4. It is also possible that both of the spacing L1 and the spacing L2 are made larger than the widthwise dimension L4. That is, at least one of the spacing L1 between the first engagement portions 74A and 74B and the spacing L2 between the second engagement portions 75A and 75B is larger than the widthwise dimension L4.

According to the present embodiment, the direction in which the first coupler 61 and the second coupler 62 are to be coupled to each other is parallel with the removing direction 100 in which the first coupler 61 in the mounted state on the mounting portion 70 is to be removed from the mounting portion 70. However, the present invention is not limited to this feature.

The removing direction 100 in which the first coupler 61 is to be removed from the mounting portion 70 is at least one of the opposite directions along a direction perpendicular to both of the widthwise direction 98 and the mounting direction 99. The removing direction 100 is determined from the relation between the spacings L1 and L2 and the widthwise dimension L4 and hence is a direction from the support portions 72A and 72B toward one of the spacing L1 and the spacing L2, whichever is larger than the widthwise dimension L4.

Specifically, in cases where the spacing L1 between the first engagement portions 74A and 74B is made larger than the widthwise dimension L4 while the spacing L2 between the second engagement portions 75A and 75B made smaller than the widthwise dimension L4, the direction opposite to the removing direction 100 indicated in FIG. 6, i.e., the direction from the support portion 72A toward the first engagement portion 74A (i.e., the direction from the support portion 72B toward the first engagement portion 74B) serves as the removing direction 100 in which the first coupler 61 is to be removed from the mounting portion 70. In cases where both of the spacing L1 and the spacing L2 are made larger than the widthwise dimension L4, each of the opposite directions along the direction perpendicular to both of the widthwise direction 98 and the mounting direction 99 serves as the removing direction 100.

On the downstream side of the mounting portion 70 in the removing direction 100 in which the first coupler 61 is to be removed from the mounting portion 70 there is provided a space which allows the first and second couplers 61 and 62 in the state of being coupled to each other to be placed therein.

The support portion 72A and the inclined portion 73A, as well as the support portion 72B and the inclined portion 73B, may be formed of a leaf spring. By imparting elasticity to the support portion 72A and the inclined portion 73A as well as the support portion 72B and the inclined portion 73B, further improvement can be made in the operability of mounting the first coupler 61 on the mounting portion 70 and in the operability of removing the first coupler 61 from the mounting portion 70.

According to the foregoing embodiment, the downstream ends of the respective engagement arms 612 and 613 in the removing direction 100 are fixed to the first coupler body 611. Alternatively, the upstream ends of the respective engagement arms 612 and 613 in the removing direction 100 may be fixed to the first coupler body 611.

The above-described structure of the mounting portion 70 for mounting the first coupler 61 thereon is applicable even to an arrangement in which the first coupler 61 is a female coupler and the second coupler 62 is a male coupler. Further, the above-described structure of the mounting portion 70 for mounting the first coupler 61 thereon is applicable even to an arrangement in which the second coupler 62 is connected to the second connection terminal 63 through the electrical wiring line 94 while the first coupler 61 is connected to the electromagnetic clutch 336 through the electrical wiring line 95.

The secondary transfer belt unit 33 is one exemplary functional unit. The structure of the mounting portion 70 for mounting the first coupler 61 thereon is applicable to other functional units.

The foregoing embodiments should be construed to be illustrative and not limitative of the present invention in all the points. The scope of the present invention is defined by the following claims, not by the foregoing embodiments. Further, the scope of the present invention is intended to include the scopes of the claims and all possible changes and modifications within the senses and scopes of equivalents.

What is claimed is:

1. A structure of a component mounting portion configured to mount thereon a component provided with a pair of engagement arms having an elastic force such as to enable the engagement arms to move toward and away from each other in a widthwise direction as a first direction of first, second and third directions which are perpendicular to each other, the structure comprising a pair of support members for holding the component therebetween by pressure contact therewith when the component is in a mounted state on the component mounting portion, wherein:

the pair of support members each have: a support portion extending in the second direction which is a mounting direction in which the component is to be mounted on the component mounting portion, the support portion being pressure-contacted by an associated one of the engagement arms when the component is in the mounted state; an inclined portion which is inclined in a direction toward a counterpart inclined portion in such manner that both inclined portions mutually approach closer downstream in the mounting direction and which is continuous with an upstream end of the support portion; and first and second engagement portions located at opposite ends of the support portion in the third direction;

a spacing between the first engagement portions and a spacing between the second engagement portions are smaller than a spacing between the support portions;

at least one of the spacing between the first engagement portions and the spacing between the second engagement portions is larger than a widthwise dimension of the component across the engagement arms which is taken on when the engagement arms are displaced into a position at which the widthwise dimension of the component is minimized within a range of motion of the engagement arms by elastic deformation; and a space allowing the component to be placed therein is provided on a downstream side of the component mounting portion in a removing direction in which the component is to be removed from the component mounting portion and which is at least one of opposite directions along the third direction.

2. The structure according to claim 1, wherein the support portion and the inclined portion are formed of a leaf spring.

3. The structure according to claim 1, wherein:

the component is a first coupler of a coupler pair comprising first and second couplers which are couplable to each other and which are located at an intermediate portion of an electrical wiring line associated with electrical components, the first coupler being provided with the pair of engagement arms; and a space allowing the first and second couplers in a state of being coupled to each other to be placed therein is provided on the downstream side of the component mounting portion in the removing direction.

4. A functional unit comprising:

electrical components;

a housing supporting the electrical components;

a coupler pair comprising first and second couplers which are couplable to each other and which are located at an intermediate portion of an electrical wiring line associated with the electrical components; and a mounting portion located in the housing and configured to mount thereon the first coupler provided with a pair of engagement arms having an elastic force such as to enable the engagement arms to move toward and away from each other in a widthwise direction as a first direction of first, second and third directions which are perpendicular to each other, the mounting portion comprising a pair of support members for holding the first coupler therebetween by pressure contact therewith when the first coupler is in a mounted state on the mounting portion, wherein:

the pair of support members each have: a support portion extending in the second direction which is a mounting direction in which the first coupler is to be mounted on the mounting portion, the support portion being pressure-contacted by an associated one of the engagement arms when the first coupler is in the mounted state; an inclined portion which is inclined in a direction toward a counterpart inclined portion in such manner that both inclined portions mutually approach closer downstream in the mounting direction and which is continuous with an upstream end of the support portion; and first and second engagement portions located at opposite ends of the support portion in the third direction;

a spacing between the first engagement portions and a spacing between the second engagement portions are smaller than a spacing between the support portions;

at least one of the spacing between the first engagement portions and the spacing between the second engagement portions is larger than a widthwise dimension of the first coupler across the engagement arms which is taken on when the engagement arms are displaced into a position at which the widthwise dimension of the first coupler is minimized within a range of motion of the engagement arms by elastic deformation; and a space allowing the first and second couplers in a state of being coupled to each other to be placed therein is provided on a downstream side of the mounting portion in a removing direction in which the first coupler is to be removed from the mounting portion and which is at least one of opposite directions along the third direction.

* * * * *